US006244321B1

(12) United States Patent
Sakamoto

(10) Patent No.: US 6,244,321 B1
(45) Date of Patent: Jun. 12, 2001

(54) AUTOMATIC WEB MATERIAL CONNECTING APPARATUS

(75) Inventor: Hiroshi Sakamoto, Tokyo (JP)

(73) Assignee: Japan Tobacco, Inc., Tokyo (JP)

( * ) Notice: Subject to any disclaimer, the term of this patent is extended or adjusted under 35 U.S.C. 154(b) by 0 days.

(21) Appl. No.: 08/224,588

(22) Filed: Apr. 7, 1994

(30) Foreign Application Priority Data

Apr. 8, 1993 (JP) ..... 5-081679

(51) Int. Cl.[7] ..... B65H 21/00

(52) U.S. Cl. ..... 156/504; 156/159; 156/505; 83/553

(58) Field of Search ..... 156/157, 159, 156/502, 504, 505; 83/553, 659; 269/218; 100/264, 271

(56) References Cited

U.S. PATENT DOCUMENTS

| | | | | |
|---|---|---|---|---|
| 3,847,046 | | 11/1974 | Schermund . | |
| 3,898,900 | | 8/1975 | Schermund . | |
| 4,010,911 | * | 3/1977 | Heitmann | 156/505 X |
| 4,157,934 | * | 6/1979 | Ryan et al. | 156/505 X |
| 4,492,138 | * | 1/1985 | Breuers et al. | 83/553 X |
| 4,720,320 | * | 1/1988 | Niemi | 156/159 X |
| 4,995,936 | | 2/1991 | Cohn . | |
| 5,064,488 | * | 11/1991 | Dickey | 156/159 |

FOREIGN PATENT DOCUMENTS

| | | | | |
|---|---|---|---|---|
| 1141848 | | 12/1962 | (DE) . | |
| 2628577 | | 1/1977 | (DE) . | |
| 0167917 | | 1/1986 | (EP) . | |
| 0179243 | | 4/1986 | (EP) . | |
| 775111 | * | 6/1954 | (GB) | 269/218 |

* cited by examiner

*Primary Examiner*—Mark A. Osele
(74) *Attorney, Agent, or Firm*—Birch, Stewart, Kolasch & Birch, LLP

(57) ABSTRACT

An automatic paper web connecting apparatus includes a pair of blocks arranged so as to be able to move relatively and be pressed against each other in the direction to cross a feed path for one paper web and a feed path for the other paper web, retaining mechanism for retaining the two paper webs on the respective opposite faces of their corresponding blocks by suction, a cutting mechanism for cutting a desired one of the paper webs, and a drive mechanism for relatively moving the blocks. The cutting mechanism includes a rotating body rockable between the two paper web feed paths on the upper-course side of the blocks, first and second knives fixed individually to the blocks, and a third knife fixed to the rotating body. The rotating body is rotated between a first rotational position in which the third knife faces the first knife and a second rotational position in which the third knife faces the second knife. The desired one paper web is cut by means of the third knife and one of the first and second knives, which is selected depending on the rotational position of the rotating body, while the blocks are moving relatively to each other.

12 Claims, 16 Drawing Sheets

AUTOMATIC WEB MATERIAL CONNECTING APPARATUS

BACKGROUND OF THE INVENTION

The present invention relates to an automatic belt-shaped material connecting apparatus.

In tobacco binding operation of a cigarette manufacturing machine, for example, a paper web should be supplied without a break. To attain this, a number of reels each wound with a paper web are provided so that a reel with a new or virgin paper web can be set in position before the remainder of a paper web on a reel in service is reduced to zero, that is, before the in-service reel is emptied. In this case, the leading end of the virgin web is connected to the in-service web by means of a paper web connecting unit, and the in-service web is cut off. Thus, the used and virgin paper webs are connected. Generally, a paper web feeding apparatus can be fitted with two reels so that when the remainder of a paper web on one reel becomes insufficient, a virgin paper web can be fed from the other reel. After connecting the virgin web to the in-service web, the paper web connecting unit cuts off the latter. When the remainder of the new paper web becomes insufficient after the replacement, another virgin paper web is supplied from another reel which is set in place of the empty reel in the feeding apparatus. The new virgin web is connected to the in-service web by means of the connecting unit, and the in-service web is then cut off. This operation is repeatedly performed so that the paper web can be continuously supplied to a winder. Packaging materials are connected in like manner in a packaging material feeding apparatus which is used to feed packaging materials, such as paper, to a packaging machine, in a cigarette manufacturing machine.

In connecting and cutting the paper webs or other belt-shaped materials alternately supplied from the two systems as described above, the one paper web is fed through its corresponding feed path, an the other paper web through another feed path. Each feed path is defined by upper-course feed rollers, guide roller, feed belt, and lower-course feed rollers. Each paper web is cut by means of a cutter which is formed of a stationary knife and a rotating knife, arranged between the upper-course feed rollers and the guide roller.

In connecting the virgin paper web to the paper web in service, the leading end of the virgin web is delivered to the lower-course feed rollers in a manner such that it is retained on the feed belt by suction, while the in-service web is cut, by means of the cutter, in a position where its trailing end overlaps the leading end of the virgin web. Thereupon, the leading end of the virgin paper web is connected to the in-service paper web between the lower-course feed rollers. Paper web cutting mechanisms of this type are described in, for example, U.S. Pat. Nos. 3,898,900 and 3,847,046 (corresponding to Japanese Provisional Patent Publication Nos. 49-77280 and 49-77282, respectively).

In these conventional cutting mechanisms, however, the paper web feed paths are provided individually with the cutters. Accordingly, these mechanisms are subject to drawbacks including complicated construction and increased components, as well as low operating efficiency.

SUMMARY OF THE INVENTION

The present invention has been contrived in consideration of these circumstances, and its object is to provide an automatic belt-shaped material connecting apparatus which enjoys high operating efficiency and compact construction.

An automatic belt-shaped material connecting apparatus according to the present invention comprises a pair of blocks arranged so as to be able to move relatively and be pressed against each other in the direction to cross a feed path for a first belt-shaped material and a feed path for a second belt-shaped material, retaining means for retaining the first and second belt-shaped materials on the respective opposite faces of the pair of blocks, cutting means, associated with the pair of blocks, for cutting a desired one of the first and second belt-shaped materials, and driving means for relatively moving the pair of blocks, whereby the desired one belt-shaped material is cut by means of the cutting means while the blocks are moving relatively to each other.

Preferably, the automatic belt-shaped material connecting apparatus further includes first and second guide rollers, spaced at a distance from each other, and a third guide roller for defining the feed path for the first belt-shaped material in conjunction with the first guide roller and defining the feed path for the second belt-shaped material in conjunction with the second guide roller.

Preferably, moreover, each of the pair of blocks is movable.

Preferably, moreover, the driving means includes a pair of connecting rods, each having one end connected to a corresponding one of the pair of blocks, and a cylinder actuator having a rod connected with the respective other ends of the connecting rods. Furthermore, the cutting means includes a rotating body rockable between the feed paths for the first and second belt-shaped materials on the upper-course side of the pair of blocks, first and second knives fixed individually to the pair of blocks, a third knife fixed to the rotating body, and actuator means for rotating the rotating body between a first rotational position in which the third knife faces the first knife and a second rotational position in which the third knife faces the second knife. The desired one belt-shaped material is cut by means of the third knife and one of the first and second knives selected depending on the rotational position of the rotating body.

An advantage of the present invention is that one of the two belt-shaped materials supplied separately from two systems can be selectively cut by means of a single cutter mechanism, so that the operating efficiency for cutting the materials can be improved, and the components of the apparatus can be reduced in number. Moreover, a belt-shaped material in service can be cut, and at the same time, the leading end of a virgin belt-shaped material can be connected to the trailing end of the in-service material, by only moving the pair of blocks relatively to each other. Thus, the connecting operation can be speeded up, and the connecting apparatus can be made compact.

These and other objects and advantages will become more readily apparent from an understanding of the preferred embodiments described below with reference to the following drawing figures.

BRIEF DESCRIPTION OF THE DRAWINGS

The invention will become more fully understood from the detailed description herein below with reference to the accompanying figures, given by way of illustration only and not intended to limit the present invention in which.

DETAILED DESCRIPTION

Figure 1:
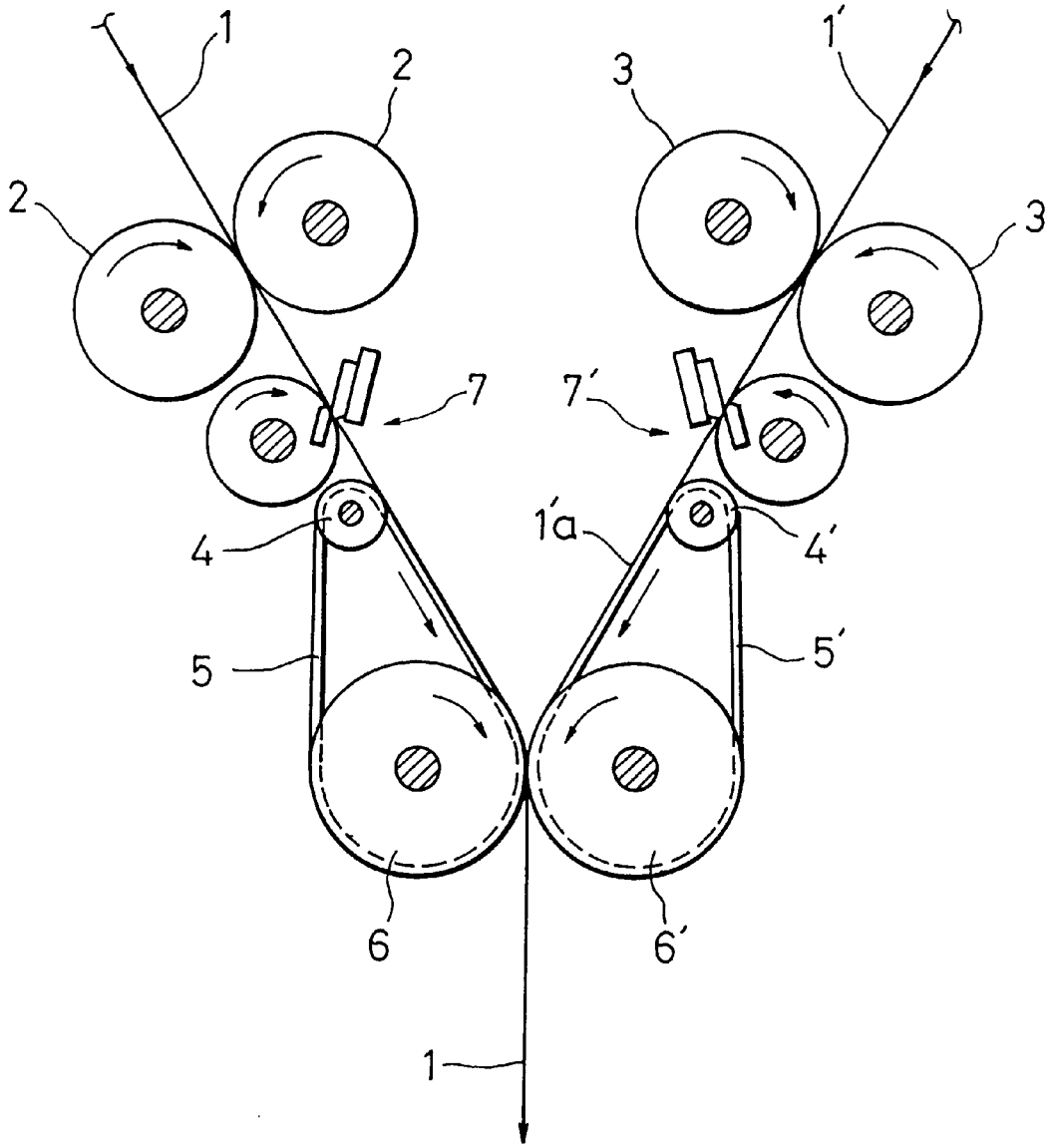
FIG. 1 PRIOR ART
FIG. 1 is a schematic view showing a conventional paper web cutting/connecting mechanism.

Referring to FIG. 1, there is shown a conventional mechanism for connecting and cutting paper webs which are alternately supplied from two systems. In this mechanism, one paper web 1 is transported past a pair of feed rollers 2, guide roller 4, feed belt 5, and feed rollers 6 and 6', while the other paper web 1' is transported past a pair of feed rollers 3, guide roller 4', feed belt 5', and feed rollers 6 and 6'. Cutters 7 and 7', each formed of a stationary knife and a rotating knife, are arranged between the feed roller pair 2 and the guide roller 4 and between the feed roller pair 3 and the guide roller 4', respectively. In this arrangement, the paper webs 1 and 1' are cut separately.

In connecting the virgin paper web 1' to the paper web 1 in service, a leading end 1'*a* of the web 1' is delivered to the feed rollers 6 and 6' in a manner such that it is retained on the feed belt 5' by suction, while the in-service web 1 is cut, by means of the cutter 7, in a position where its trailing end overlaps the leading end 1'*a* of the web 1'. Thereupon, the leading end 1'*a* of the paper web 1' is connected to the paper web 1 between the feed rollers 6 and 6'. The connection between the trailing end of the web 1 and the leading end 1'*a* of the web 1' is achieved by, for example, previously pasting a double-coated tape on the leading end 1'*a* of the web 1' and then bonding this web end to the trailing end of the web 1 with the aid of the feed rollers 6, 6'. Likewise, in connecting the paper web 1 to the paper web 1', the web 1' is cut by means of the cutter 7'. Cutting mechanisms of this type for paper webs or other belt-shaped material are described in, for example, U.S. Pat. Nos. 3,898,900 and 3,847,046.

In these conventional cutting mechanisms, however, feed paths for the paper webs 1 and 1' are provided, respectively, with the cutters 7 and 7' for cutting the trailing ends of the webs. Accordingly, these mechanisms are subject to drawbacks including complicated construction and increased components, as well as low operating efficiency.

The following is a description of a paper web feeding apparatus furnished with an automatic paper web connecting apparatus as an automatic belt-shaped material connecting apparatus according to one embodiment of the present invention.

The paper web feeding apparatus, which constitutes part of a cigarette manufacturing machine, serves to feed a paper web to a winder of the machine.

General Configuration

Figure 2:
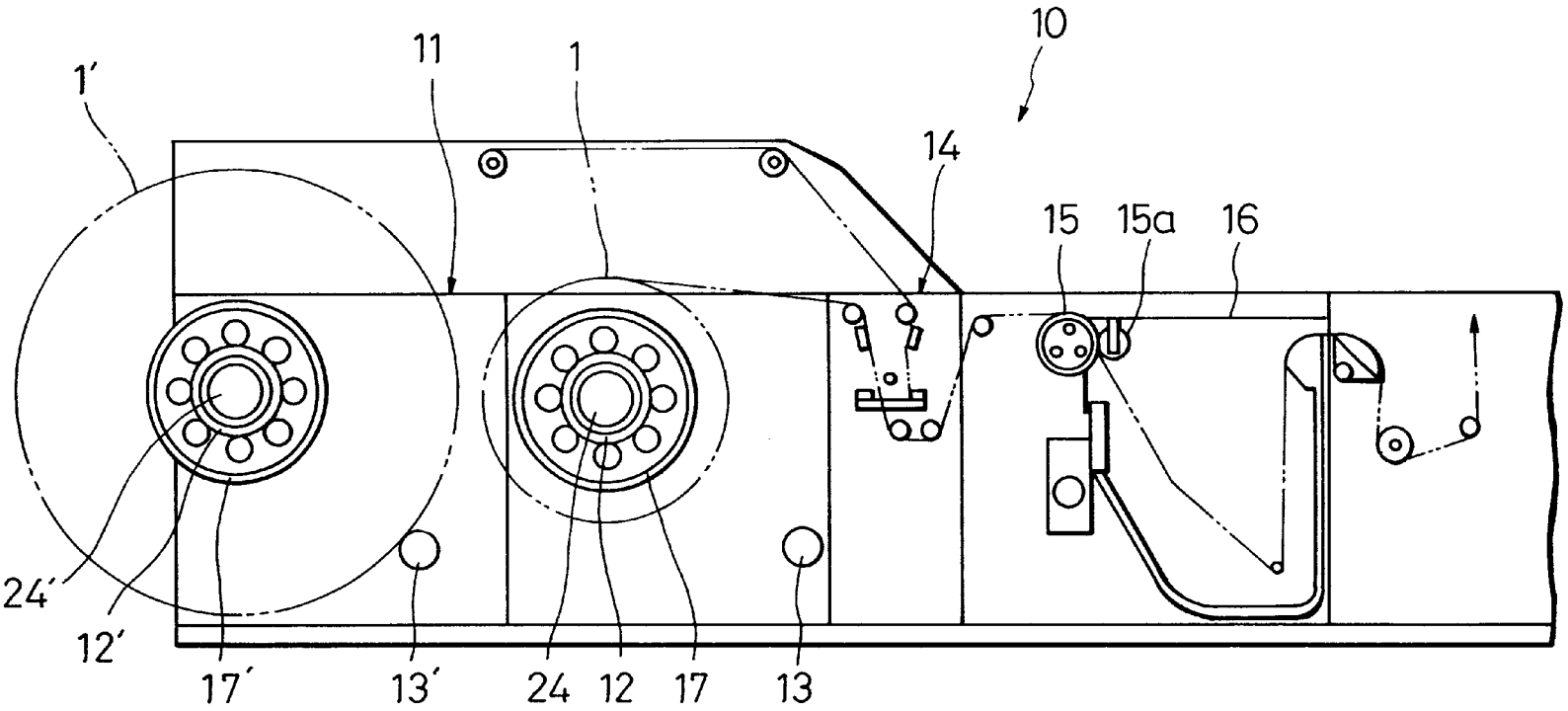
FIG. 2 is a schematic front view showing a paper web feeding apparatus furnished with an automatic belt-shaped material connecting apparatus according to one embodiment of the present invention.

Referring to FIG. 2, the paper web feeding apparatus 10 comprises two bobbins 12 and 12' fitted with reels 17 and 17' which are wound with paper webs 1 and 1', respectively. The paper web from one of the reels is fed to the winder (not shown) through a reservoir box 16 and a printing section (not shown) by rotating a pulling roller 15 by means of a servomotor (designated by numeral 250 in FIG. 24) for use as roller driving means in a manner such that the web is held between the roller 15 and a pinch roller 15*a*. The pinch roller 15*a*, in conjunction with the pulling roller 15, constitutes roller means for delivering the paper web.

The paper web feeding apparatus 10 further comprises a mechanism for applying tension to the paper web traveling from the apparatus 10 toward the winder and a mechanism for adjusting the traveling position of the paper web, whereby the travel of the paper web can be stabilized.

Furthermore, the paper web feeding apparatus 10 comprises an automatic paper web connecting unit 14 and a reel mounting unit. The connecting unit 14 connects the paper web on one reel to the paper web on the other reel when the remainder of the web on the first reel is reduced to a critical degree. The reel mounting unit is used to set the reels in the paper web feeding apparatus 10 so that the reels are removable. Thus, the paper web can be continuously fed to the winder, and manual operations for the paper web connection and reel attachment and detachment can be reduced considerably.

In the paper web feeding apparatus 10 according to the present embodiment, the reel mounting unit, tensioning mechanism, and paper web traveling position adjusting mechanism are arranged in and around two rotating shafts 24 and 24' for use as reel mounting shafts on which the reels 17 and 17' are mounted by means of the bobbins 12 and 12', respectively. Thus, the feeding apparatus 10 enjoys a compact design.

The following is a detailed description of various parts of the paper web feeding apparatus 10.

Rotating Shaft (Reel Mounting Shaft)

Figure 3:
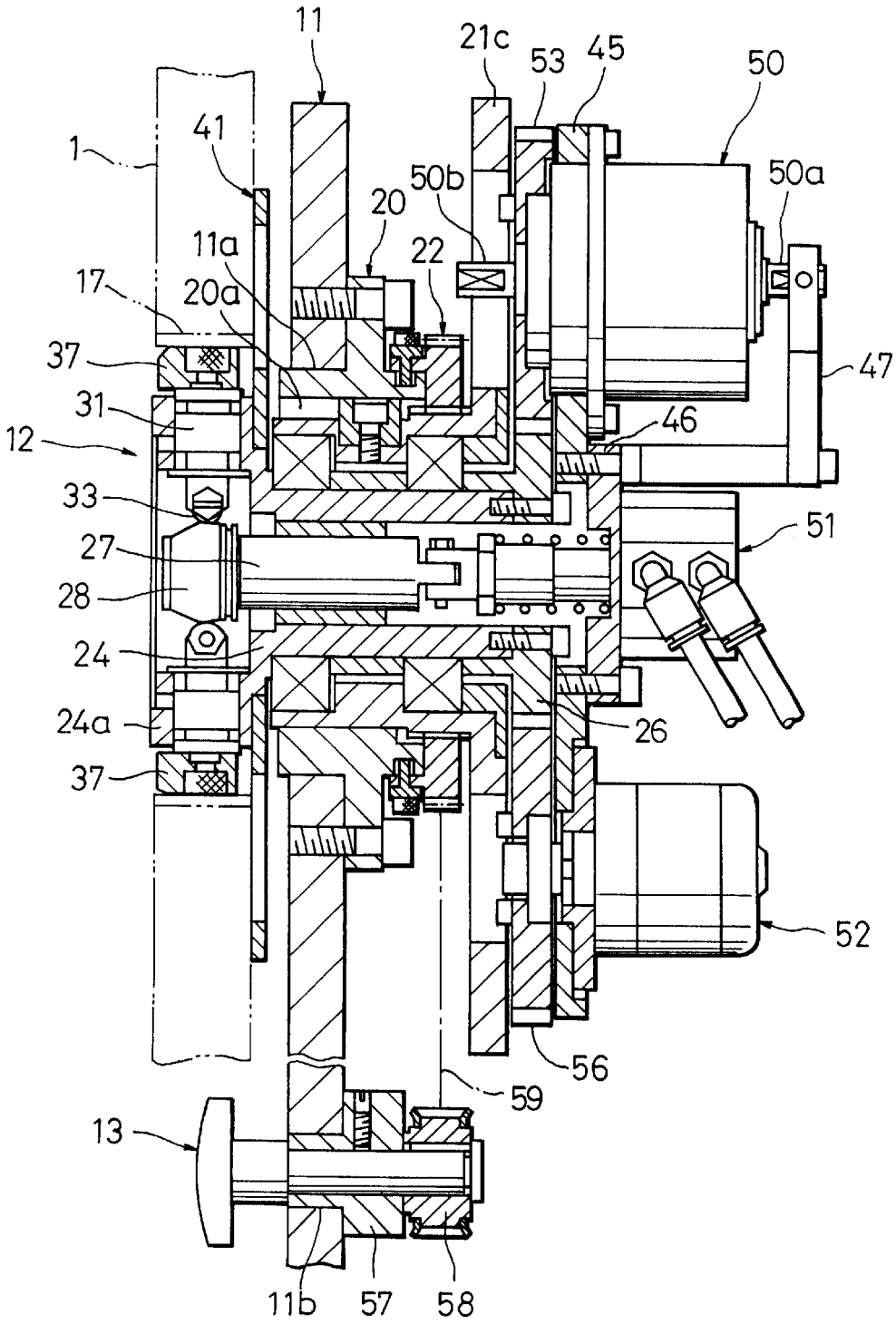
FIG. 3 is a sectional view showing a reel mounting shaft of the feeding apparatus of FIG. 2 and its peripheral elements.
Figure 4:
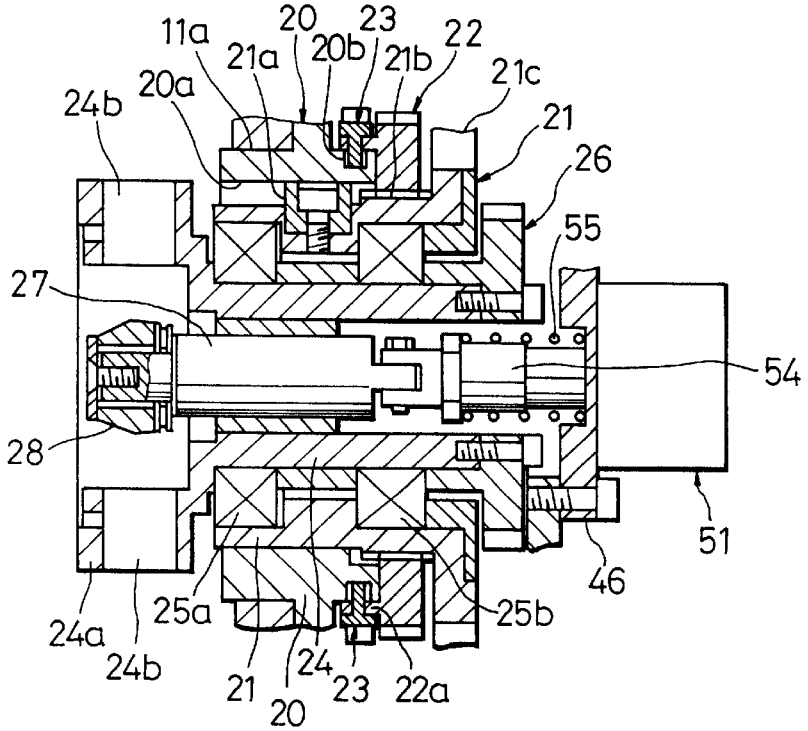
FIG. 4 is a fragmentary enlarged view showing the reel mounting shaft of FIG. 3 and its peripheral elements.

Referring to FIGS. 3 and 4, an outer cylinder 20 is fixed to a front wall 11, which constitutes part of the body of the paper web feeding apparatus 10, by means of bolts. An inner cylinder 21 is fitted in the outer cylinder 20 so as to be slidable and nonrotatable with respect to the cylinder 20. The hollow rotating shaft 24 is rotatably supported in the inner cylinder 21 by means of bearings 25*a* and 25*b*. Thus, the shaft 24 is supported for rotation in the paper web feeding apparatus body. The other rotating shaft 24' is also supported for rotation in the apparatus body.

More specifically, the front end of the outer cylinder 20 is fitted in a large hole 11*a* which is bored through the front wall 11. A flange, which is formed substantially on the middle portion of the outer peripheral surface of the outer cylinder 20, is fixed to the front wall 11 by means of the bolts. A key way 20*a* is formed extending axially on the inner surface of the outer cylinder 20, while an annular groove 20*b* is formed extending circumferentially on the outer peripheral surface of the rear end portion of the cylinder 20. A mating key 21*a* for the key way 20*a* is fixed to the outer peripheral surface of the inner cylinder 21, whereby the cylinder 21 is fitted in the outer cylinder 20 so as to be slidable in the axial direction and nonrotatable.

The rotating shafts 24 and 24' are located in positions such that they do not interfere with the reels 17 and 17' with their maximum web roll diameters when the reels are mounted on their corresponding shafts.

Reel Mounting Unit

The reel mounting unit (bobbin clamping mechanism) is provided with the bobbins 12 and 12' as holder means for removably mounting the reels 17 and 17' on the rotating shafts 24 and 24'. Since bobbins 12 and 12' have the same construction, only the bobbin 12 will be described below.

The bobbin 12 has a variable-diameter holder with a variable outside diameter which is mounted on the rotating shaft 24. The holder includes movable holder elements 37, e.g., four in number, which are supported on the shaft 24 for movement in the radial direction of the shaft 24. Each holder element 37 is movable between a reel mounting position, in which its outer peripheral surface is pressed against a shaft hole defining surface of the reel, and a reel removing position, in which its outer peripheral surface is separated inward from the shaft hole defining surface of the reel with respect to the radial direction of the rotating shaft. More generally, the variable-diameter holder is designed so that its outside diameter is variable between a first diameter such that the holder can be pressed into a shaft hole of the reel 17 and a second diameter such that the holder can be disengaged from the reel shaft hole. The outside diameter of the variable-diameter holder is the diameter of an imaginary circle which is touched by the respective outer peripheral surfaces of the movable holder elements 37.

The reel mounting unit further comprises a holder drive mechanism for changing the outside diameter of the holder. The holder drive mechanism associated with the bobbin 12 includes a driving shaft 27 arranged for axial reciprocation in the hollow of the rotating shaft 24, and a cylinder actuator for reciprocating the shaft 27. The cylinder actuator is formed of, e.g., a sprung single-acting air cylinder 51, whose cylinder chamber is selectively communicated with a compressed air source 210 or the atmosphere by means of a three-way solenoid valve 211, which operates under the control of a control unit 200, as shown in FIG. 24.

When the supply of compressed air to the air cylinder 51 is stopped, a rod 54 is advanced by the agency of a spring 55, whereupon the outside diameter of the holder of the bobbin 12 increases to the level of the first diameter, so that the reel 17 is unremovably supported by means of the bobbin 12. As the compressed air is supplied, on the other hand, the rod 54 is retreated to reduce the outside diameter of the holder to the level of the second diameter, so that the reel 17 is allowed to be removed from the bobbin 12.

Figure 24:
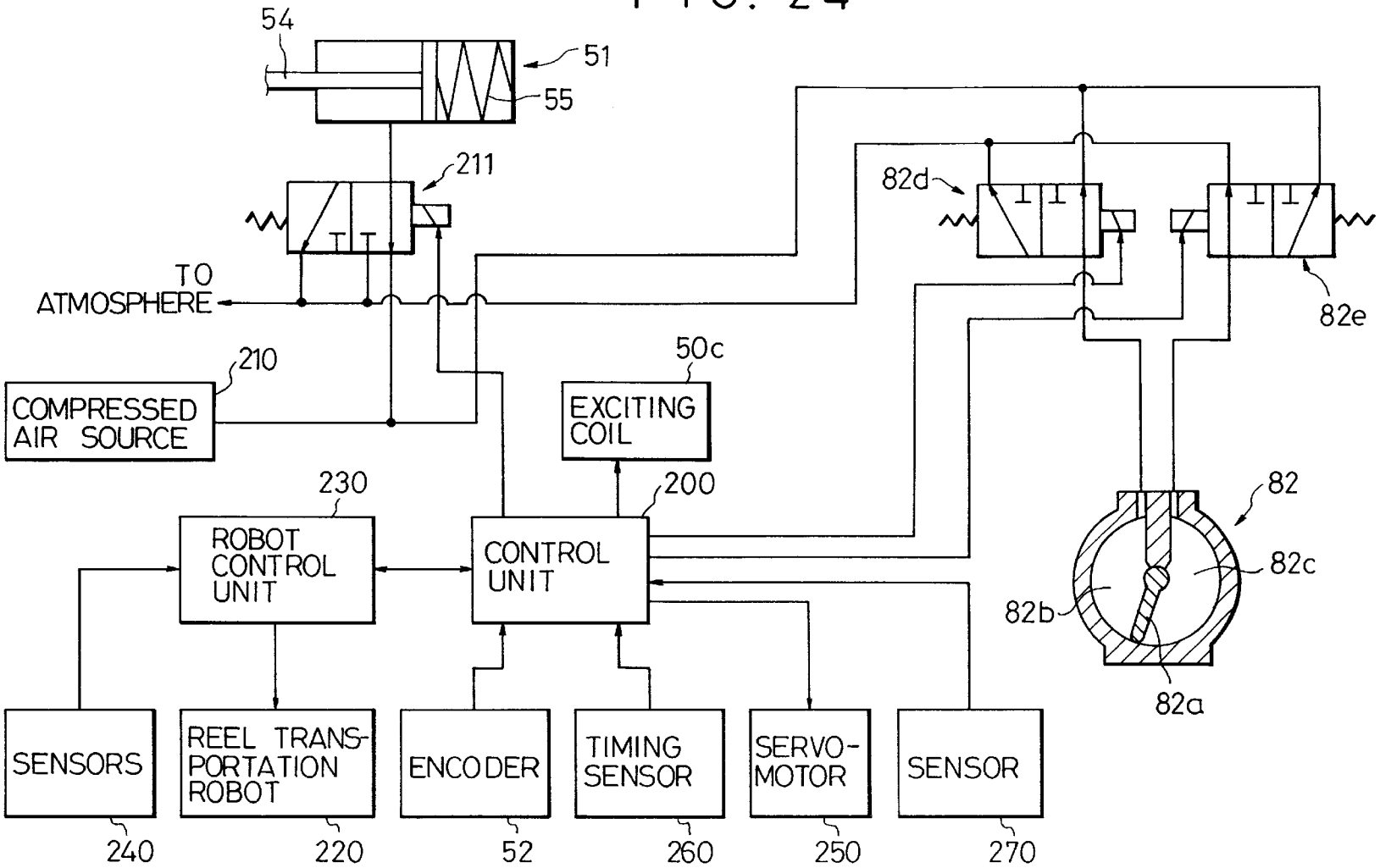
FIG. 24 is a schematic block diagram schematically showing a control unit of the paper web connecting unit along with its peripheral elements.

Preferably, a robot 220 is used to transport the reel between a reel storage space and the paper web feeding apparatus, and signals are transferred between the control unit 200 and a robot control unit 230 for controlling the operation of the robot, as shown in FIG. 24. In this arrangement, the control units 200 and 230 cooperate to control the operation of the robot 220 for the reel transportation and the operation of the reel mounting unit for the reel attachment and detachment. In this case, the attachment and detachment of the reel to and from the paper web feeding apparatus are automated. In FIG. 24, numeral 240 designates various sensors for detecting the robot operation.

The following is a further description of the reel mounting unit constructed in this manner.

As shown in FIG. 3, the air cylinder 51 is fixed to a support plate 46 on another support plate 45, which is fixed to a large-diameter flange 21*c* on the rear end of the inner cylinder 21 across a given space. The rod 54 (FIG. 4) of the cylinder 51 is loosely fitted in the rotating shaft 24, and its distal end is connected to the rear end of the shaft 27. A return spring 55 (FIG. 4) is interposed compressed between a flange on the distal end of the rod 54 and the support plate 46.

A thick large-diameter flange 24*a* is formed on the front end of the rotating shaft 24. Holes 24*b*, e.g., four in number, are bored through the peripheral wall of the flange 24*a* so as to be arranged at regular intervals in the circumferential direction of the flange. Each hole 24*b* extends in the radial direction of the shaft 24. The shaft 27 is fitted in the hollow of the shaft 24 by means of a bearing for relative rotation and axial sliding motion. A taper cam 28 is rotatably mounted on the front end of the shaft 27 by means of a thrust bearing 29 and a bearing 30. The rear half portion of the cam 28 is in the form of a cylinder having a uniform diameter, and the front portion thereof forms a taper surface tapered toward the front end. In other words, the front portion of the cam 28 is in the form of a truncated cone.

Figure 5:
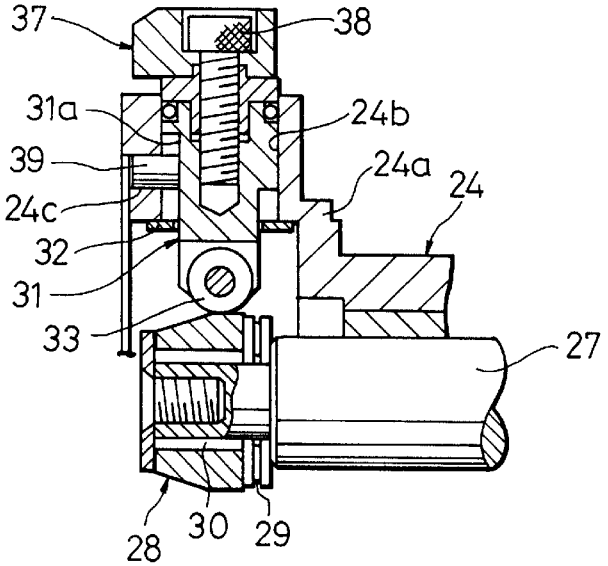
FIG. 5 is a fragmentary enlarged view showing the principal part of the reel mounting shaft of FIG. 3.
Figure 7:
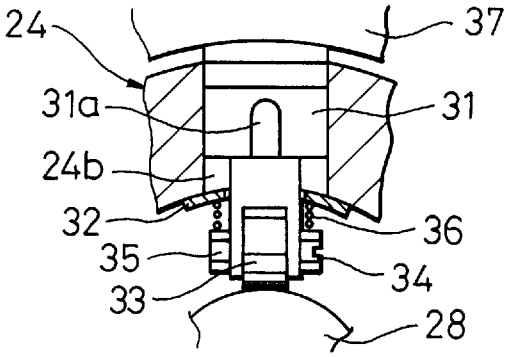
FIG. 7 is a fragmentary enlarged view showing the principal part of the bobbin of FIG. 6.
Figure 8:
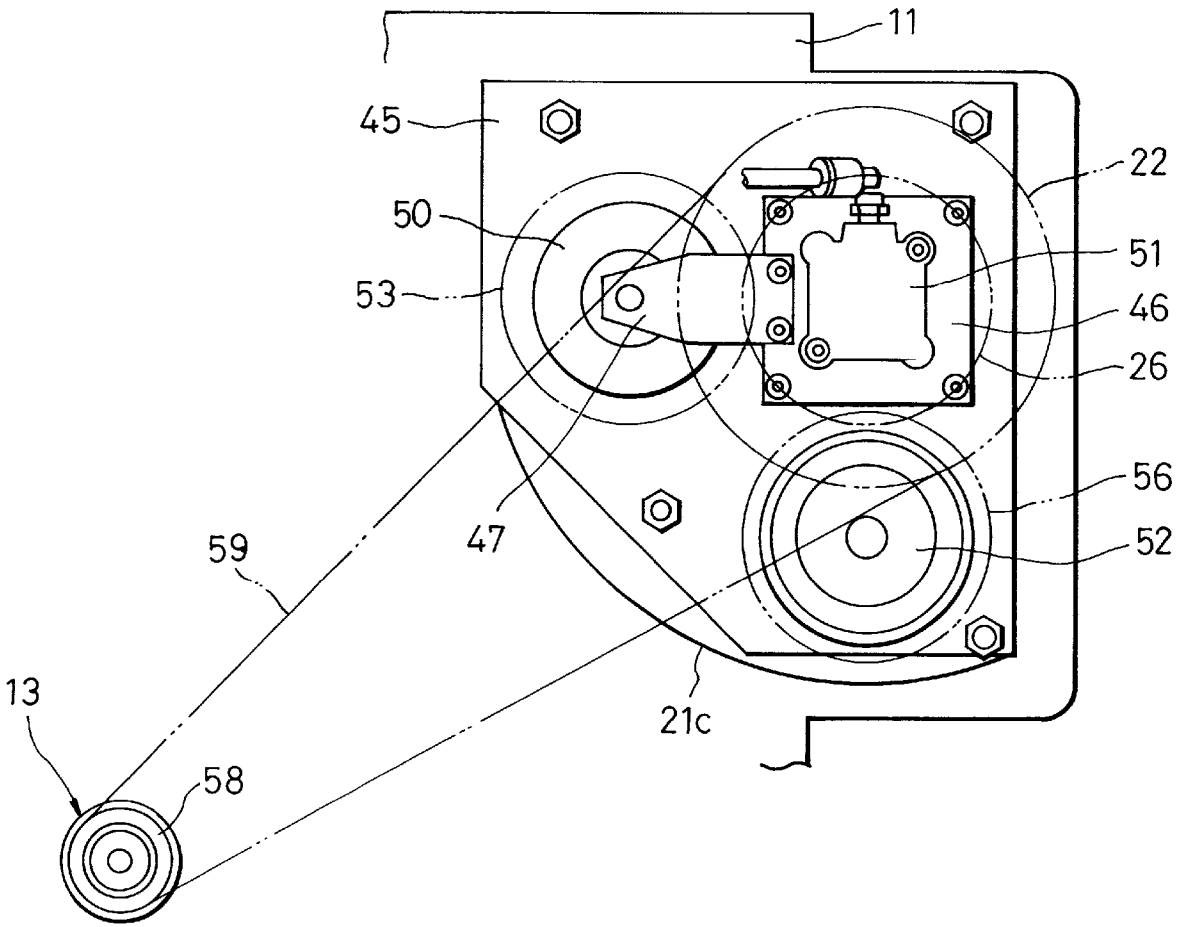
FIG. 8 is a rear view of elements shown in FIG. 3.

As shown in FIG. 5, a shaft 31 is slidably fitted in each hole 24*b* of the flange 24*a*, and a slit 31*a* is formed in the outer peripheral surface of shaft 31 so as to extend along the axis of the shaft 31. The proximal end of the shaft 31 is loosely fitted in a hole of a spring shoe 32, and faces the taper cam 28 across a narrow gap. A roller 33 is rotatably mounted on the proximal end of the shaft 31 by means of a shaft bolt 34 and a nut 35 (FIG. 7). As shown in FIG. 7, a spring 36 is interposed compressed between the spring shoe 32 and the respective peripheral surfaces of the head of the bolt 34 and the nut 35. The spring 36 causes the shaft 31 to withdraw, and presses the roller 33 against the taper cam 28 for rolling motion.

Figure 6:
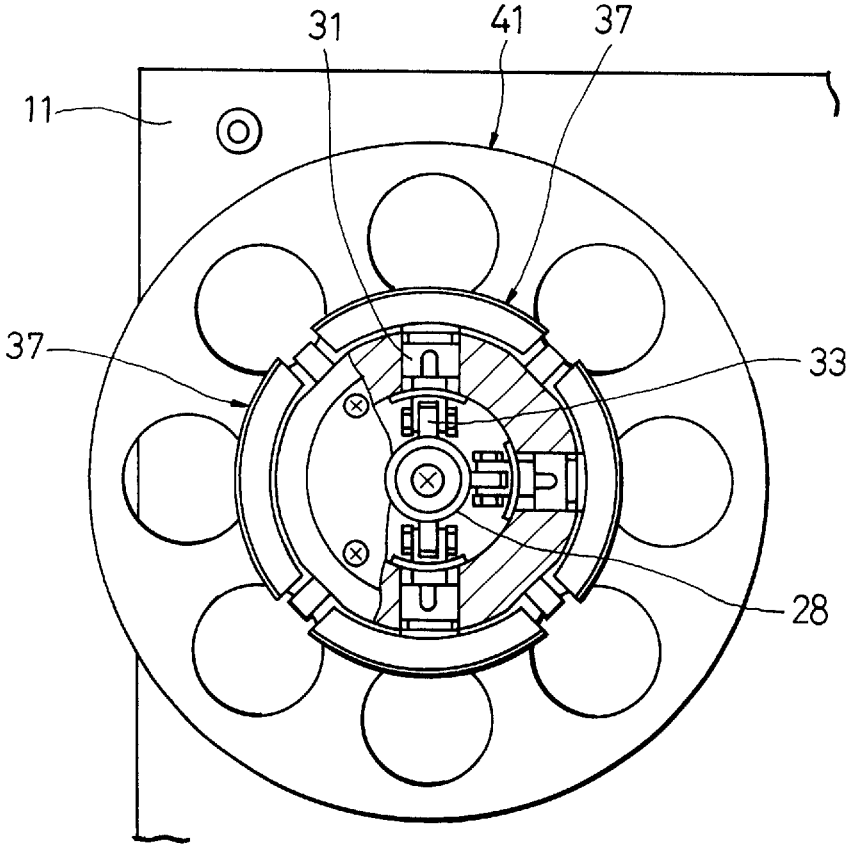
FIG. 6 is a partly cutaway front view of a bobbin shown in FIG. 2.

As shown in FIGS. 5 and 6, the middle portion of each movable holder element 37, substantially in the form of a quadrant, is fixed to the distal end of the shaft 31 by means of a bolt 38. One end of a pin 39, the other end of which is fitted in a hole 24*c* bored in the end face of the flange 24*a*, is slidably fitted in the slit 31*a* of shaft 31. Thus, the shaft 31 is slidable, though nonrotatable, toward and away from the rotating shaft 24 in its corresponding hole 24*b* of the flange 24*a*. As the taper cam 28 reciprocates in the axial direction, the shaft 31 slides toward or away from the rotating shaft 24 in the hole 24*c* of the flange 24*a* with the roller 33 rolling, whereby variable-diameter holder, formed of the four holder elements 37, expands or contracts in diameter.

Paper Web Traveling Position Adjusting Mechanism

The paper web traveling position adjusting mechanism moves the bobbins 12 and 12' back and forth, thereby adjusting the travel of the paper webs 1 and 1'. An arrangement of this mechanism on the side of the bobbin 12 is identical with that on the side of the bobbin 12'. The following is a description of the arrangement on the side of the bobbin 12 only.

The traveling position adjusting mechanism includes a traveling position adjusting knob 13 (FIG. 3). The knob 13 extends through a hole 11*b* in the front wall 11, and is fixed to a shaft which is rotatably supported on the wall 11 by means of a bearing 57. A toothed pulley 58 is fixed to the rear end of the shaft of the knob 13. A toothed belt 59 is passed around and between the pulley 58 and a toothed pulley 22 which is screwed on the inner cylinder 21 of the bobbin 12.

As shown in FIG. 4, the toothed pulley 22 is in the form of a large ring, and a thread formed on its inner peripheral surface is engagedly fitted on a thread 21*b* of the inner cylinder 21. A ring-shaped flange 22*a* protrudes axially from the front end face of the pulley 22, covering the whole outer peripheral edge of the end face. A plurality of pins 23 are screwed in the flange 22*a* so as to be arranged at regular intervals in the circumferential direction of the flange. The respective tip ends of the pins 23 are slidably fitted in the annular groove 20*b* of the outer cylinder 20. Thus, the pulley 22 is supported on the outer cylinder 20 so as to be rotatable with respect to the cylinder 20 and axially immovable.

By rotating the knob 13, the toothed pulley 22 is rotated by means of the toothed belt 59 which is in engagement with the toothed pulley 58 of the knob 13, and the inner cylinder 21 is axially moved with respect to the outer cylinder 20 to move the bobbin 12 back and forth, whereby the travel of the paper web is adjusted. Meanwhile, the paper web traveling position adjustment is performed such that an edge of the paper web is aligned with reference lines (not shown) formed on guide plates 62, 62' (mentioned later).

Tensioning Mechanism

The tensioning mechanism applies braking force to the rotating shafts 24 and 24', thereby tensioning the paper webs 1 and 1' delivered from the reels 17 and 17'. An arrangement of this mechanism on the side of the web 1 is identical with that on the side of the web 1'. The following is a description of the arrangement on the side of the paper web 1 only.

The tensioning mechanism is composed of a powder brake 50 for use as an electrical brake, a rotary encoder 52 for generating a predetermined number of pulses with every revolution of the reel 17, a timing sensor (designated by numeral 260 in FIG. 24) for generating a pulse with every revolution of the pulling roller 15, and the control unit 200. The control unit 200 determines the diameter of the roll of the paper web 1 on the reel 17 in accordance with pulse outputs from the encoder 52 and the sensor 260, and controls the operation of the powder brake 50 in accordance with the roll diameter so that the braking force applied to the rotating shaft 24 has an optimum value. The web roll diameter of the reel 17 is equal to the product of the diameter of the pulling roller 15 and the number of revolutions of the roller 15 for each revolution of the reel 17. Thus, the roll diameter can be calculated on the basis of the pulse outputs from the rotary encoder 52 and the sensor 260 and the roller diameter. The optimum braking force is previously set so that the braking force decreases in a curve of second degree, for example, as the roll diameter is reduced.

As shown in FIG. 3, the powder brake 50 and the rotary encoder 52 are supported by means of the support plate 45 which is fixed to the flange 21*c* of the inner cylinder 21. The powder brake 50 has its input shaft 50*a* fixed to the support plate 46 by means of a bracket 47 and its output shaft 50*b* fixedly fitted with a gear 53, which is in mesh with a gear 26 on the rotating shaft 24. Also, the brake 50 includes an input-side element (driving member) and an output-side element (driven member), arranged for relative rotation across a powder gap, and an exciting coil 50*c* (FIG. 24) disposed around the brake 50 so that magnetic flux can be passed through high-permeability powder (magnetic iron powder) which fills the powder gap. The coil 50*c* is connected to the control unit 200.

When the input-side element is rotating with the exciting coil de-energized, the powder in the powder brake 50 is pressed against the operating surface of the input-side element by centrifugal force. Thus, the input- and output-side elements are not connected at all, so that no torque is transmitted from the input-side element to the output-side element. When the exciting coil is energized, the particles of the powder are coupled in a chain, and torque is transmitted from the input-side element to the output-side element by coupling force between the powder particles and frictional force between the powder and the operating surface. The transmitted torque can be controlled by adjusting the exciting power of the exciting coil, that is, exciting current.

The input side of the powder brake 50 is fixed in the aforesaid manner, and the output side engages the gear 26 of the rotating shaft 24 through the medium of the gear 53. Accordingly, the output-side torque or braking force applied to the shaft 24 can be freely controlled by adjusting the exciting current. Thus, the braking force can be set with higher accuracy for the powder brake 50 than for the mechanical brake, so that an optimum tension can be applied to the paper web with stability. Moreover, the brake 50 enjoy high wear resistance, and its maintenance and inspection are easy.

A gear 56, which is fixed to the shaft of the rotary encoder 52, is in mesh with the gear 26 (FIG. 3) of the rotating shaft 24. The encoder 52 is connected electrically to the control unit 200.

Automatic Paper Web Connecting Unit

Figure 9:
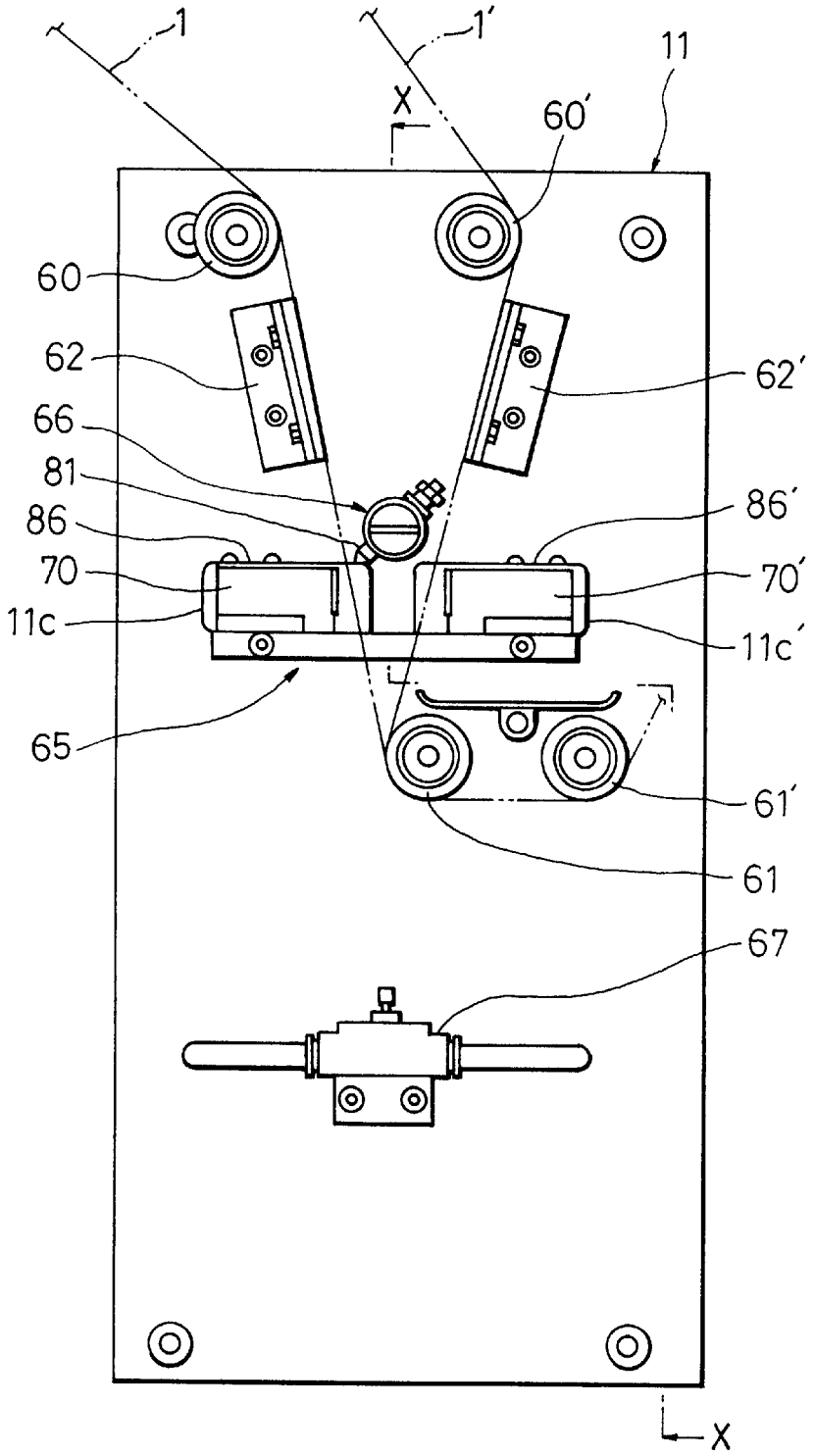
FIG. 9 is a front view of an automatic paper web connecting unit shown in FIG. 2.
Figure 10:
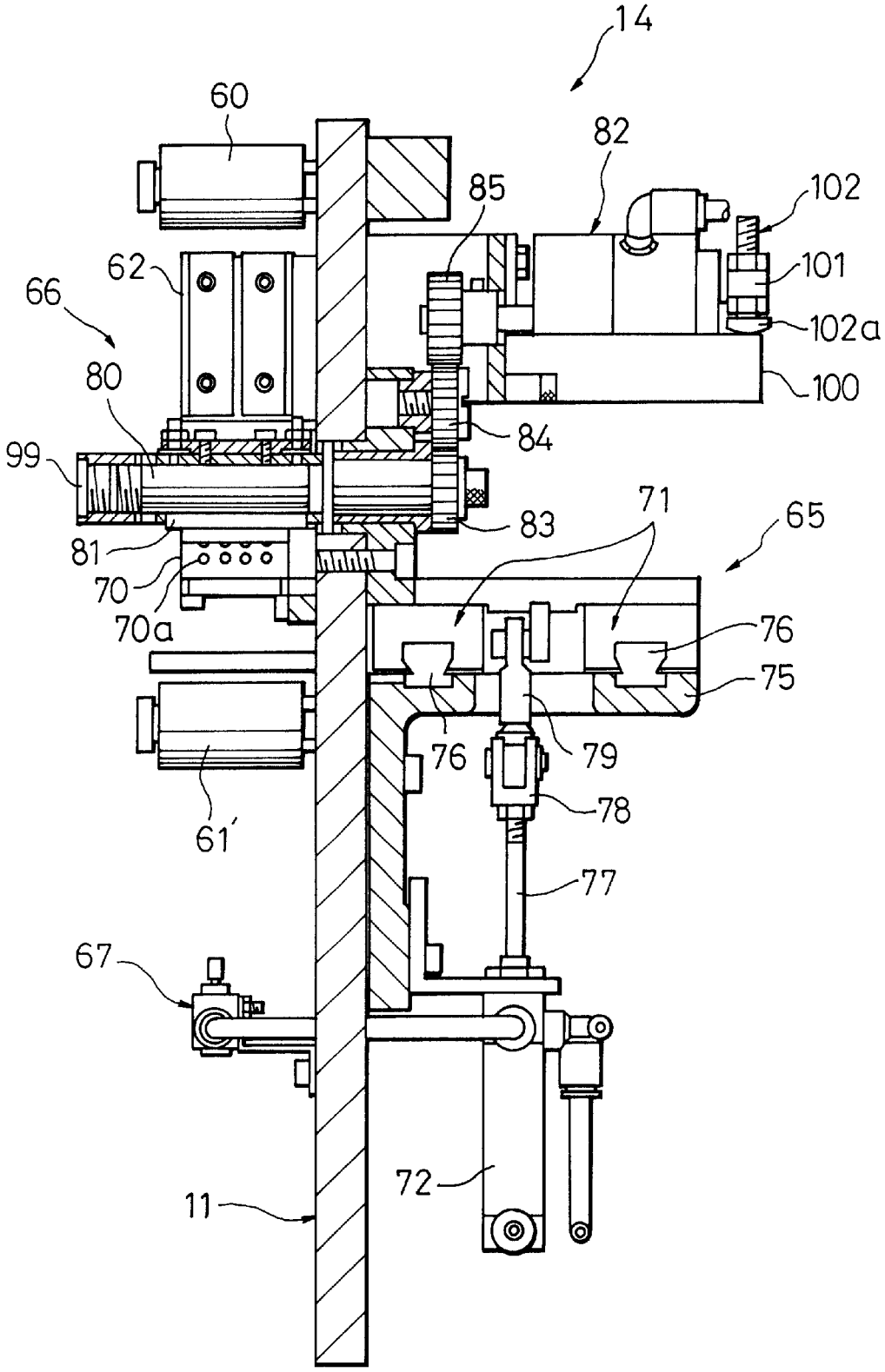
FIG. 10 is a sectional view taken along line X—X of FIG. 9.
Figure 11:
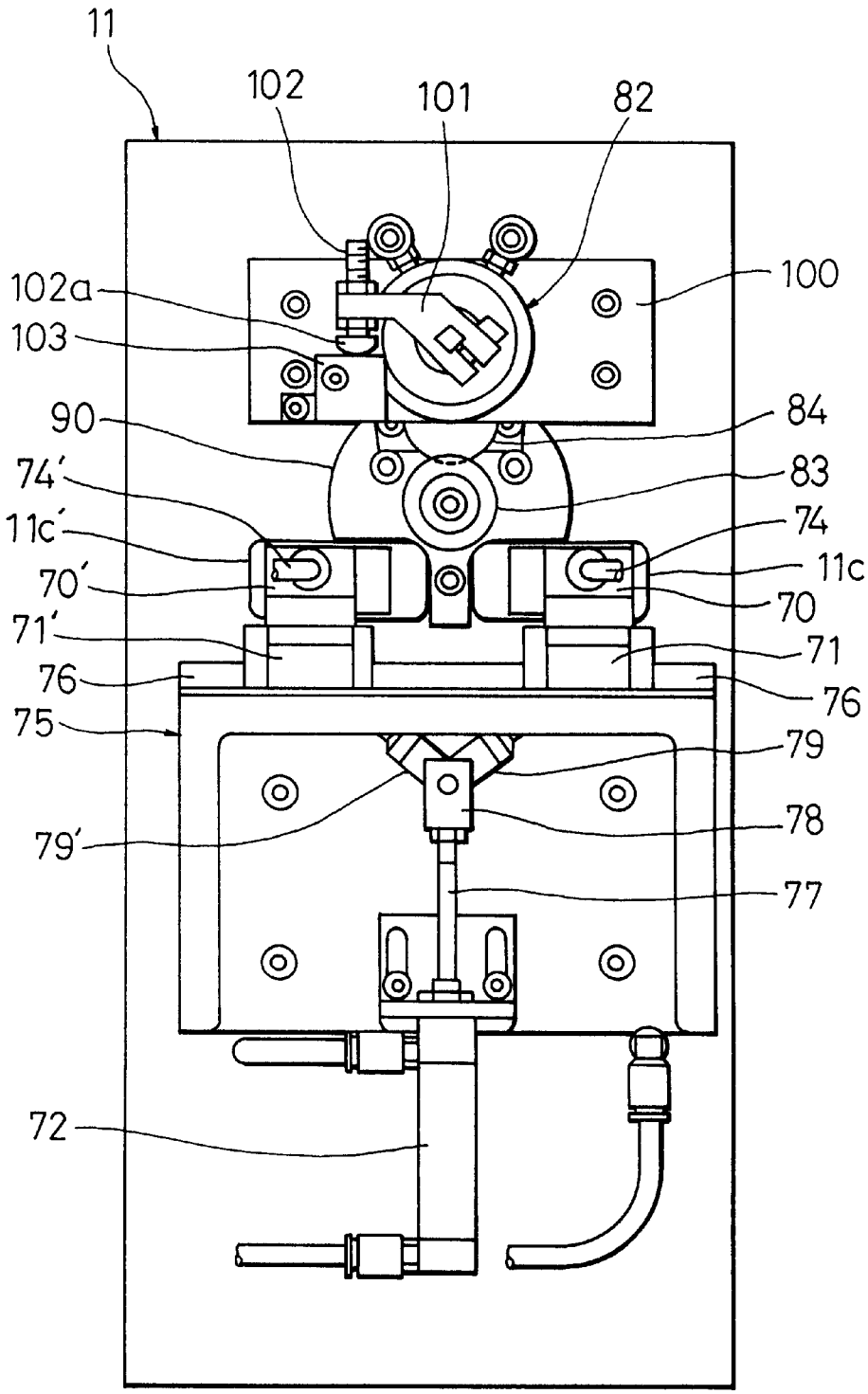
FIG. 11 is a rear view of the automatic paper web connecting unit shown in FIG. 9.

The automatic paper web connecting unit, which is designated by numeral 14 in FIG. 2, connects the used and virgin paper webs and cuts the used web by simply moving and pressing a pair of press blocks 70 and 70' against each other. As shown in FIGS. 9 to 11, the connecting unit comprises a clamp mechanism 65 for pressing the press blocks 70 and 70' against each other and a cutter mechanism 66 for cutting the paper web.

The clamp mechanism 65 is provided with the press blocks 70 and 70' which are arranged for relative movement in the direction to cross feed paths for the paper webs 1 and 1' so that they can be pressed against each other. Thus, the webs 1 and 1' can be retained on the respective opposite faces of the blocks by suction under negative pressure. The cutter mechanism 66 includes a rotating shaft 80 rotatable between the feed paths for the paper webs 1 and 1', on the upper-course side of the blocks 70 and 70', first and second knives 86 and 86' fixed to the blocks 70 and 70', respectively, a third knife 81 fixed to the shaft 80, and a rotary cylinder 82. The cylinder 82 serves to rotate the rotating shaft 80 between a first rotational position, in which the third knife 81 faces the first knife 86, and a second rotational position in which the third knife 81 faces the second knife 86'. As the blocks 70 and 70' move toward each other, the used paper web is cut by means of the third knife 81 and the first or second knife 86 or 86', depending on the rotational position of the shaft 80.

More specifically, the automatic paper web connecting unit 14 comprises guide rollers 60 and 60' arranged side by side on the upper portion of the front face of the front wall 11 of the paper web feeding apparatus, guide rollers 61 and 61' arranged side by side substantially in the center of the front face of the wall 11, and guide plates 62 and 62' located directly under the rollers 60 and 60', respectively, as shown in FIG. 9. The guide rollers 60, 61 and 61' and the guide plate 62 define the feed path (indicated by two-dot chain line in FIG. 9) for the paper web 1, while the guide rollers 60', 61 and 61' and the guide plate 62' define the feed path (indicated by two-dot chain line in FIG. 9) for the paper web 1'. The feed paths for the paper webs 1 and 1' join each other on the lower-course side of the guide roller 62.

The clamp mechanism 65 and the cutter mechanism 66 are arranged between the guide plates 62 and 62' and the guide rollers 61 and 61', and a speed controller 67 is disposed under the mechanisms 65 and 66.

The clamp mechanism 65 is composed of the left- and right-hand press blocks 70 and 70', sliders 71 and 71' (FIGS. 10 and 11) coupled to the blocks 70 and 70', respectively, and an air cylinder 72 as an actuator for driving the sliders. The blocks 70 and 70' are slidably placed on their corresponding rails 76, which are horizontally fixed to the front face of the front wall 11 of the paper web feeding apparatus. The front end portion of the block 70 which faces the block 70' is formed of a somewhat elastic material, e.g., a hard rubber member, so as to absorb an impact force acting on the paper webs 1, 1' when the blocks 70, 70' are brought into urged contact with each other through the paper webs, thereby preventing the paper webs from being cut by the impact force. As shown in FIG. 10, moreover, a number of small holes 70*a* are bored in an end face of the block 70. The holes 70*a* communicate with a vacuum unit (not shown) by means of a hollow portion (not shown) in the press block 70 and an air pipe 74, one end of which is connected to the rear face of the block 70. As the vacuum unit is operated, the paper web 1 is attracted to and held on the end face of the block 70 by means of negative pressure produced in those openings of the small holes which are directed to the block end face. The air pipe 74 is provided with, for example, a manual on-off valve (not shown). The press block 70' is constructed in the same manner as the press block 70.

A support base 75 (FIGS. 10 and 11) is fixed substantially to the center of the rear face of the front wall 11, and the two rails 76 are fixed to the top surface of the base 75. These rails horizontally extend parallel to each other at a predetermined distance. The sliders 71 and 71' are arranged on the rails 76 and 76', respectively, so as to be slidable without a possibility of their slipping off the rails. The sliders 71 and 71' penetrate their corresponding slots 11*c* and 11*c'* bored through the front wall 11, and are fixed to the press blocks 70 and 70', respectively. Thus, the blocks 70 and 70' are movable in unison with their corresponding sliders 71 and 71'.

Drive means for moving the press blocks 70 and 70' toward and away from each other includes the air cylinder 72 and connecting rods 79 and 79' for connecting a rod 77 of the cylinder 72 to the blocks 70 and 70', respectively. The upper end of the main body of the air cylinder 72 is fixed to the center of the lower portion of the support base 75. The rod 77 of the cylinder 72 extends vertically, and a bracket 78 is fixed to the distal end of the rod 77. One end of each of the connecting rods 79 and 79' is coupled to the bracket 78, and the other ends of the rods 79 and 79' are connected to the sliders 71 and 71', respectively.

The air cylinder 72 is of a double-acting type, and each of two cylinder chambers thereof is allowed to be selectively communicated with a compressed air source (not shown) or the atmosphere through a three-way valve (not shown). The three-way valve is connected electrically to the control unit 200 (FIG. 24). When the paper web feeding apparatus is not in a predetermined operating state such that the drive of the pulling roller 15 is stopped, manual operation of the three-way valve is prohibited under the control of the control unit 200. When the feeding apparatus is In the predetermined operating state, the manual operation of the valve is permitted. When compressed air is supplied to one cylinder chamber of the air cylinder 72, the rod 77 of the cylinder 72. advances to separate the sliders 71 and 71' from each other, as shown in FIGS. 9 and 11. When the compressed air is supplied to the other cylinder chamber to retreat the rod 77, on the other hand, the respective opposite faces of the sliders 71 and 71' are pressed against each other.

As shown in FIGS. 9 to 12, the cutter mechanism 66 is composed of the rotating shaft 80, the front knife 81, the rotary cylinder 82 as an actuator, gears 83, 84 and 85, the rear knives 86 and 86', etc.

Figure 12:
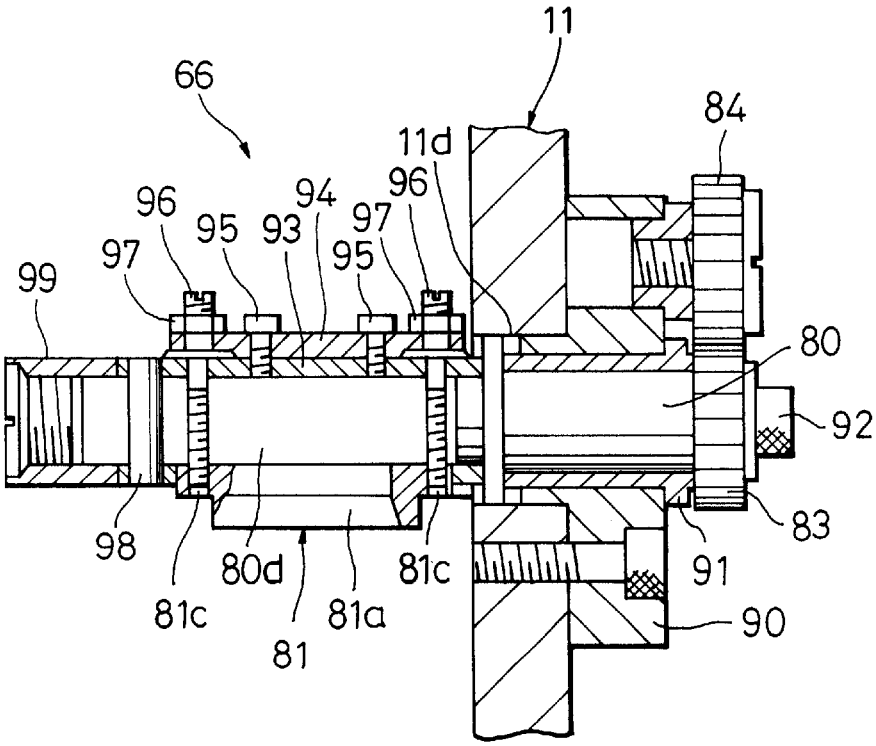
FIG. 12 is a fragmentary enlarged view showing the principal part of a cutter mechanism shown in FIG. 10.
Figure 13:
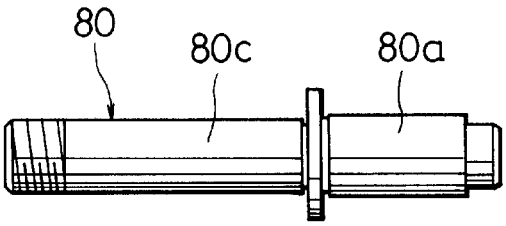
FIG. 13 is a front view of a shaft of the cutter mechanism shown in FIG. 12.
Figure 14:
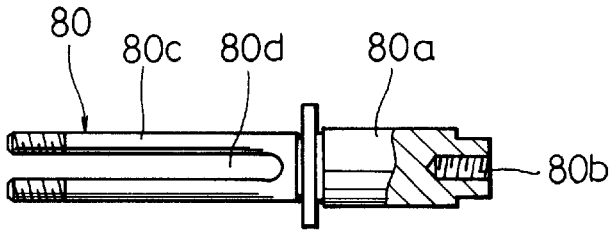
FIG. 14 is a plan view of the shaft shown in FIG. 13.

As shown in FIGS. 13 and 14, a tapped hole 80*b* is bored in the end face of a rear portion 80*a* of the rotating shaft 80, and a slit 80*d* is formed in a front portion 80*c* of the shaft 80, extending along the axis of the shaft 80 and diametrically penetrating the shaft 80. A thread is formed on the distal end of the front portion 80*c* of the shaft 80. The rotating shaft 80 extends penetrating a hole lid (FIG. 12), which is bored through that portion of the front wall 11 just over the middle position between the press blocks 70 and 70', and is rotatably supported in the wall 11 by means of a support member 90 and a bearing 91. The gear 83 is fixed to the rear end of the shaft 80 by means of a bolt 92, which is screwed in the tapped hole 80*b*.

Figure 15:
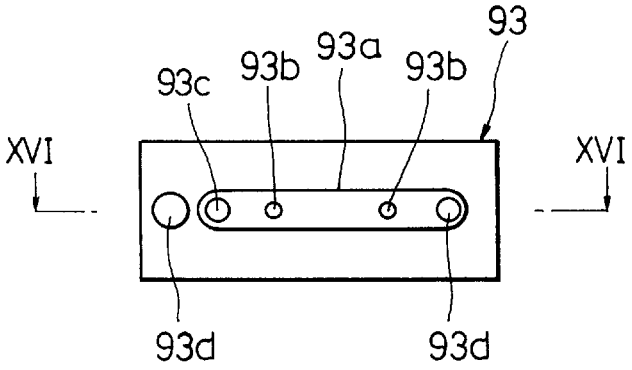
FIG. 15 is a bottom view of a holder of the cutter mechanism shown in FIG. 10.
Figure 16:
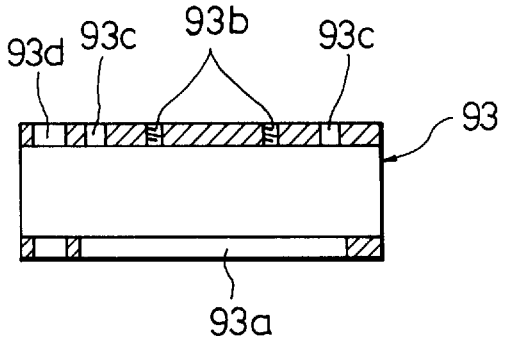
FIG. 16 is a sectional view taken along line XVI—XVI of FIG. 15.
Figure 17:
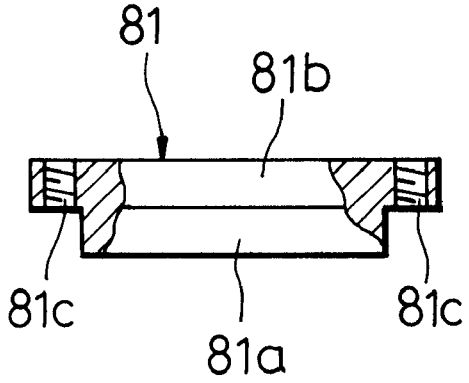
FIG. 17 is a partly cutaway front view of a front knife of the cutter mechanism shown in FIG. 10.
Figure 18:
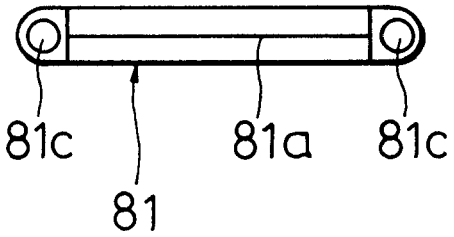
FIG. 18 is a bottom view of the front knife shown in FIG. 17.

A cylindrical holder 93 is fitted on the front portion 80*c* of the rotating shaft 80. As shown in FIGS. 15 and 16, a slit 93*a* is formed on one side of the peripheral wall of the holder 93, corresponding to the slit 80*d* of the shaft 80, and a pair of tapped holes 93*b* and a pair of bolt holes 93*c* are formed on the other side. Two aligned pin holes 93*d* are bored diametrically through the distal end of the holder 93. The front knife 81 can be inserted in the respective slits 80*d* and 93*a* of the shaft 80 and the holder 93. As shown in FIGS. 17 and 18, an edge 81*a* is formed on the lower portion of the knife 81, and a pair of tapped holes 81*c* are bored individually through the opposite ends of an upper portion 81*b* of the knife 81.

As shown in FIG. 12, the holder 93 is fitted on the front portion 80*c* of the shaft 80 in a manner such that its slit 93*a* is located under the slit 80*d* of the shaft 80 so as to be in alignment therewith. The upper portion 81*b* of the front knife 81 is inserted in the slit 93*a*. A support plate 94 is fixed to the outer peripheral surface of the upper portion of the holder 93 by means of a pair of bolts 95 which are screwed individually in the tapped holes 93*b*. Bolt holes are bored through the plate 94 so as to be in alignment with the bolt holes 93*c* of the holder 93.

The bolts 96 penetrate their corresponding bolt holes of the support plate 94 and the bolt holes 93*c* of the holder 93, and are screwed individually in the tapped holes 81*c* of the front knife 81, thereby supporting the knife 81 so that its height can be adjusted. The front knife 81 is fixed to the holder 93 by means of a pair of fixing nuts 97 which are screwed individually on the bolts 96. A pin 98 extends through the slit 80*d* of the rotating shaft 80 so that its ends are fitted individually in the pin holes 93*d* of the holder 93, whereby the holder 93 is nonrotatably anchored to the shaft 80. A cap 99 is screwed on the distal end of the shaft 80.

Referring again to FIG. 10, the rotary cylinder 82 is horizontally attached to the rear face of the front wall 11 of the paper web feeding apparatus by means of a support base 100 above the rotating shaft 80. A gear 85 is fixed to the front end of a rotating shaft of the cylinder 82. The gear 85 is in mesh with an idle gear 84 which is in engagement with the gear 83 on the rotating shaft 80. As shown in FIG. 12, the idle gear 84 is rotatably supported by means of the support member 90. As shown in FIG. 11, the proximal end of an arm 101 is fixed to the rear end of the shaft of the cylinder 82, and an adjusting bolt 102 is threadedly fixed to the distal end of the arm 101.

A stopper 103 is fixed to the support base 100 such that it can retain the adjusting bolt 102. When the rotating shaft of the rotary cylinder 82 is in a predetermined rotational position (rotation end position), a head 102*a* of the bolt 102 is caused to abut against the stopper 103, thereby holding the cylinder shaft in position. The rotary cylinder 82 includes, for example, a vane 82*a*, which is rotatable in unison with the shaft of the cylinder 82, and two cylinder chambers 82*b*, 82*c* divided by the vane, as shown in FIG. 24. Each cylinder chamber is selectively communicated with the compressed air source 210 or the atmosphere by means of a three-way valve 82*d* or 82*e* which is operated under the control of the control unit 200. The rotating shaft of the air cylinder 82 is rotated for approximately 90° by supplying compressed air to one of the cylinder chambers of the cylinder 82.

The rear knives 86 and 86' are arranged on the upper surfaces of the press blocks 70 and 70', respectively, of the clamp mechanism 65 (FIG. 9) so as to face the edge 81 of the front knife 81 on the rotating shaft 80. As the blocks 70 and 70' slide, the rear knives 86 and 86', in conjunction with the front knife 81, cut the paper web 1 or 1'.

General Operation

The following is a description of the operation of the paper web feeding apparatus constructed in this manner.

When air is supplied to the air cylinder 51 of the clamp mechanism for the bobbin 12 shown in FIGS. 3 and 4, in order to mount the reel 17, wound with the paper web 1, on the right-hand bobbin 12 (as in FIG. 2), the rod 54 is drawn into the body of the cylinder 51 to move the shaft 27 to the right of FIGS. 3 and 4. As a result, the taper cam 28 retreats toward the body of the paper web feeding apparatus. As the cam 28 retreats in this manner, the shafts 31 attached to the rotating shaft 24 are drawn radially inward by the agency of the urging force of the spring 36 (FIG. 7), so that the variable-diameter holder, formed of the four movable holder elements 37 (FIG. 6), contracts to the second diameter. Thereupon, the reel 17 is allowed to be mounted on the bobbin 12.

Then, the reel 17 wound with the paper web 1 is mounted on the holder, and air is supplied to the air cylinder 51. When this is done, the rod 54 of the cylinder 51 is forced out, so that the shaft 27 moves to the left of FIGS. 3 and 4, whereupon the taper cam 28 is pushed out forward. When the cam 28 is pushed out in this manner, the shafts 31 are pushed radially outward against the urging force of the spring 36, so that the holder is expanded to the first diameter to fix or clamp the reel 17. Thereupon, mounting the reel 17 on the bobbin 12 is finished.

The bobbin 12 is of a stationary type such that it is continually fixed to the body of the paper web feeding apparatus. The outside diameter of the bobbin 12 is variable between a first diameter such that the reel can be mounted on the bobbin and a second diameter such that the reel 17 can be removed from the bobbin. Thus, the attachment and detachment the reel 17 to and from the bobbin 12 can be easily automated.

The reel 17', wound with the paper web 1', is mounted on the left-hand bobbin 12' (FIG. 2) in the same manner as the reel 17 on the bobbin 12.

Here let it be supposed that the paper web 1 on the reel 17 mounted on the right-hand bobbin 12 of FIG. 2 is being delivered through the automatic paper web connecting unit 14 by means of the pulling roller 15, to be fed to the winder (not shown) via the reservoir box 16. In this situation, the rod 77 of the air cylinder 72 in the connecting unit 14 is extended, so that the press blocks 70 and 70' are separated from each other, as shown in FIGS. 9 and 11. At the same time, the shaft 80 of the cutter mechanism 66 is locked to the rotational position shown in FIG. 9, so that the front knife 81 faces the rear knife 86 which is fixed to the left-hand press block 70.

The paper web 1 passes the guide roller 60 and the guide plate 62, and is then guided to the guide roller 61 through a narrow gap between the press block 70 and the front knife 81, and further to the pulling roller 15 (FIG. 2) via the guide roller 61'. The pulling roller 15 is driven by means of the servomotor 250 (FIG. 24) through the medium of a transmission mechanism such as gear means. At this time, the rotational speed of the output shaft of the servomotor is controlled by means of the control unit 200, and the paper web 1 is delivered at a speed matched to the cigarette rod forming speed of the winder.

When the paper web 1 is delivered in this manner, the bobbin 12 rotates in unison with the rotating shaft 24. Thereupon, the powder brake 50 Is rotated by means of the gear 26 fixed to the shaft 24 through the medium of the gear 53, and the shaft of the rotary encoder 52 is rotated by means of the gear 56 (FIG. 3). As the reel 17 on the bobbin 12 rotates, the encoder 52 delivers its pulse output. As the pulling roller 15 rotates, on the other hand, the timing sensor 260 delivers its pulse output. In response to the pulse outputs from the encoder 52 and the sensor 260, the control unit 200 calculates the web roll diameter of the reel 17, adjusts the braking force of the powder brake 50 to the optimum braking force in accordance with the roll diameter, and applies the optimum tension to the paper web 1. Thus, the tension applied to the web 1 is stabilized.

The braking force of the powder brake 50 is controlled in three stages, e.g., heavy (for outside diameter of 550 to 400ϕ), medium (for 400 to 300ϕ), and light (for 300 to 190ϕ), depending on the roll diameter of the paper web 1. In this braking force control, the braking force is controlled so as to decrease in a curve of second degree as the web roll diameter is reduced. Thus, the braking force is controlled so as to decrease at a higher rate in a larger-diameter region as the roll is reduced, to decrease at a medium rate in a medium-diameter region, and to decrease at a lower rate in a lower-diameter region.

Preferably, the braking force is controlled depending on the operation mode of the paper web feeding apparatus, as well as that of the winder. There are operation modes which include, for example, a low-speed mode, high-speed mode, stopping mode, and suspension mode. In the high-speed mode for high-speed travel of the paper web, the braking force control is effected so that a smaller braking force than that for the lower-speed mode is applied to the paper web. In the stopping mode during which the operations of the winder and the paper web feeding apparatus are stopped following their steady operating state, the rotational speed of the pulling roller 15 is gradually reduced, and finally, the roller 15 ceases to rotate. In the braking force control in the stopping mode, therefore, the delivery of the paper web from the reel can be stopped without causing the web to slacken or break. In the braking force control in the suspension mode during which the pulling roller 15 is kept in suspension after the termination of the stopping mode, moreover, the braking force is applied to the paper web according to the web roll diameter lest the reel rotate unexpectedly.

Since the powder brake 50 is controlled by means of electromagnetic force, it wears little, and its maintenance and inspection are easy.

Figure 19:
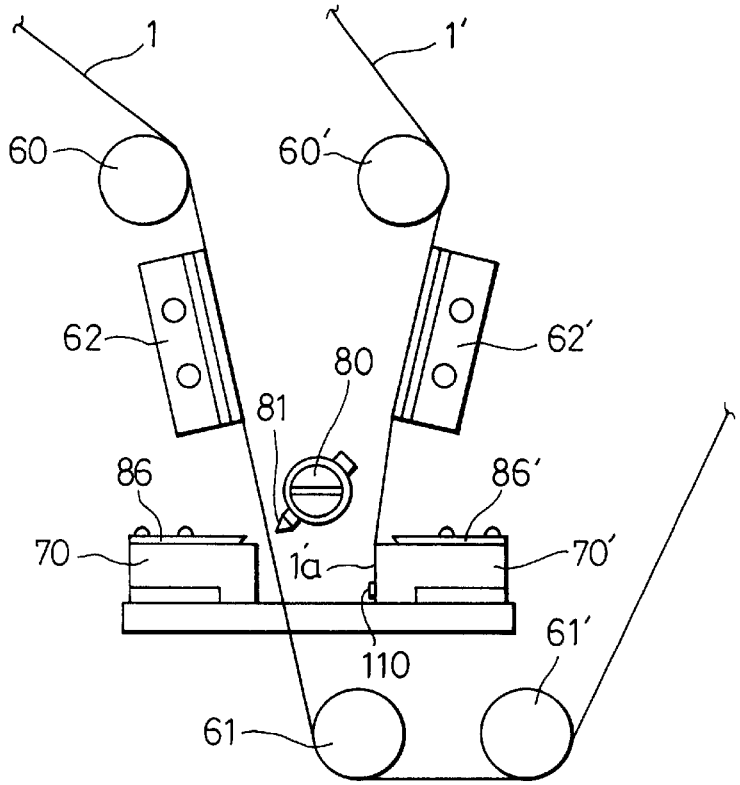
FIG. 19 is a view showing a state in which paper web connection is started with the starting end of a virgin paper web held against the end face of a press block, in the paper web connecting unit shown in FIG. 9.

When the remainder of the paper web 1 in service is reduced below a predetermined level (e.g., 176 to 178ϕ in terms of reserve diameter), the web 1 is delivered at a higher speed (e.g., 20% higher than usual) than the speed of consumption under the control of the control unit 200 (FIG. 23), and is stored in the reservoir box 16 (FIG. 2). Then, the reel 17' wound with the virgin paper web 1' is mounted on the left-hand bobbin 12'. In mounting the reel 17' on the bobbin 12', the reel 17' is automatically transported by means of the robot or the like. As shown in FIG. 19, a double-coated tape 110 is pasted on one side of the starting end 1'*a* of the web 1'. When the manual on-off valves (not shown) attached to the air pipes 74 and 74' are opened, air is sucked from the inside of the press blocks 70 and 70' through the pipes by means of the vacuum unit, while the outside air is sucked in through the small holes 70*a* in the respective end faces of the blocks. Thus, a negative pressure is produced on the block end faces such that the starting end 1'*a* of the web 1' can be attracted to the end faces. In this state, the operator prepares for the connection of the paper webs by causing that side of the starting end 1'*a* opposite to the side pasted with the double-coated tape 110 to be retained on the end face of the press block 70' by suction (FIG. 19).

Figure 20:
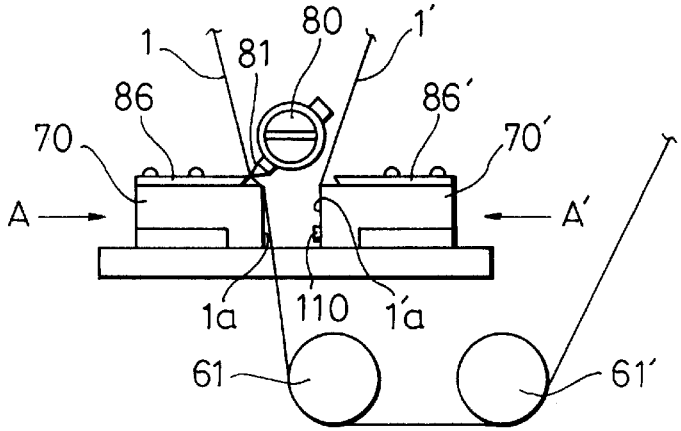
FIG. 20 is a view showing the way a paper web in service is cut in the paper web connecting unit.

Then, the paper web supply from the reel 17 is restarted. When the remainder of the paper web 1 on the reel 17 is further reduced, the drive of the pulling roller 15 is stopped under the control of the control unit 200 (FIG. 23), and the delivery of the web 1 from the reel 17 is suspended. When the roller 15 is stopped, the three-way valve for allowing or preventing the compressed air supply to the air cylinder 72 (FIG. 11) is allowed to be operated manually. In order to connect the paper web 1 and the virgin paper web 1', therefore, the operator manually operates the three-way valve associated with the rod retreating cylinder chamber so that the compressed air is supplied to this chamber. Thereupon, the rod 77 of the cylinder 72 retreats, so that the press blocks 70 and 70' move toward each other in the directions of arrows A and A' of FIG. 20. Accordingly, the rear knife 86 fixed to the block 70, in conjunction with the front knife 81, cuts the paper web 1 slidingly. The moment the web 1 is cut, its terminal end 1*a* is attracted to the end face of the press block 70 by sucking force.

Figure 21:
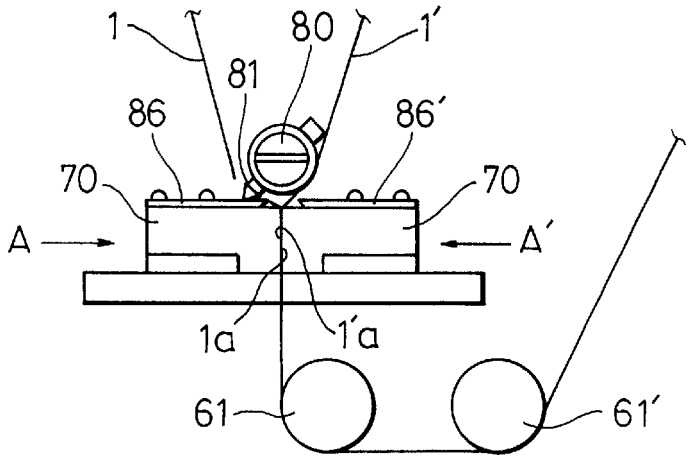
FIG. 21 is a view showing the way the virgin paper web is connected to the paper web in service.
Figure 22:
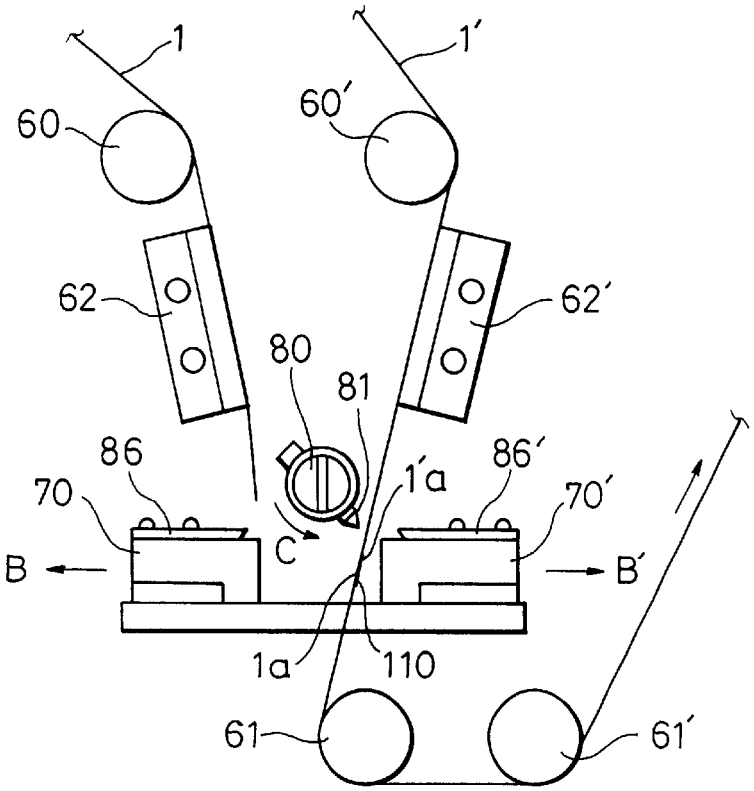
FIG. 22 is a view showing a completion of the paper web connection.

Further, the press blocks 70 and 70' move toward each other in a manner such that the terminal end la of the paper web 1 and the starting end 1'*a* of the paper web 1' retained individually on them by suction. When the opposite faces of the blocks are pressed against each other, as shown in FIG. 21, the respective ends 1*a* and 1'*a* of the webs 1 and 1' are bonded by means of the double-coated tape 110 under pressure. Subsequently, the three-way valve associated with the rod advancing cylinder chamber of the air cylinder 72 is manually operated so that the compressed air is supplied to this chamber. Thereupon, the rod 77 of the cylinder 72 advances, so that the press blocks 70 and 70' move away from each other in the directions of arrows B and B' of FIG. 22, thereby releasing the paper webs 1 and 1'. Then, the blocks 70 and 70' return to their respective original positions.

Figure 23:
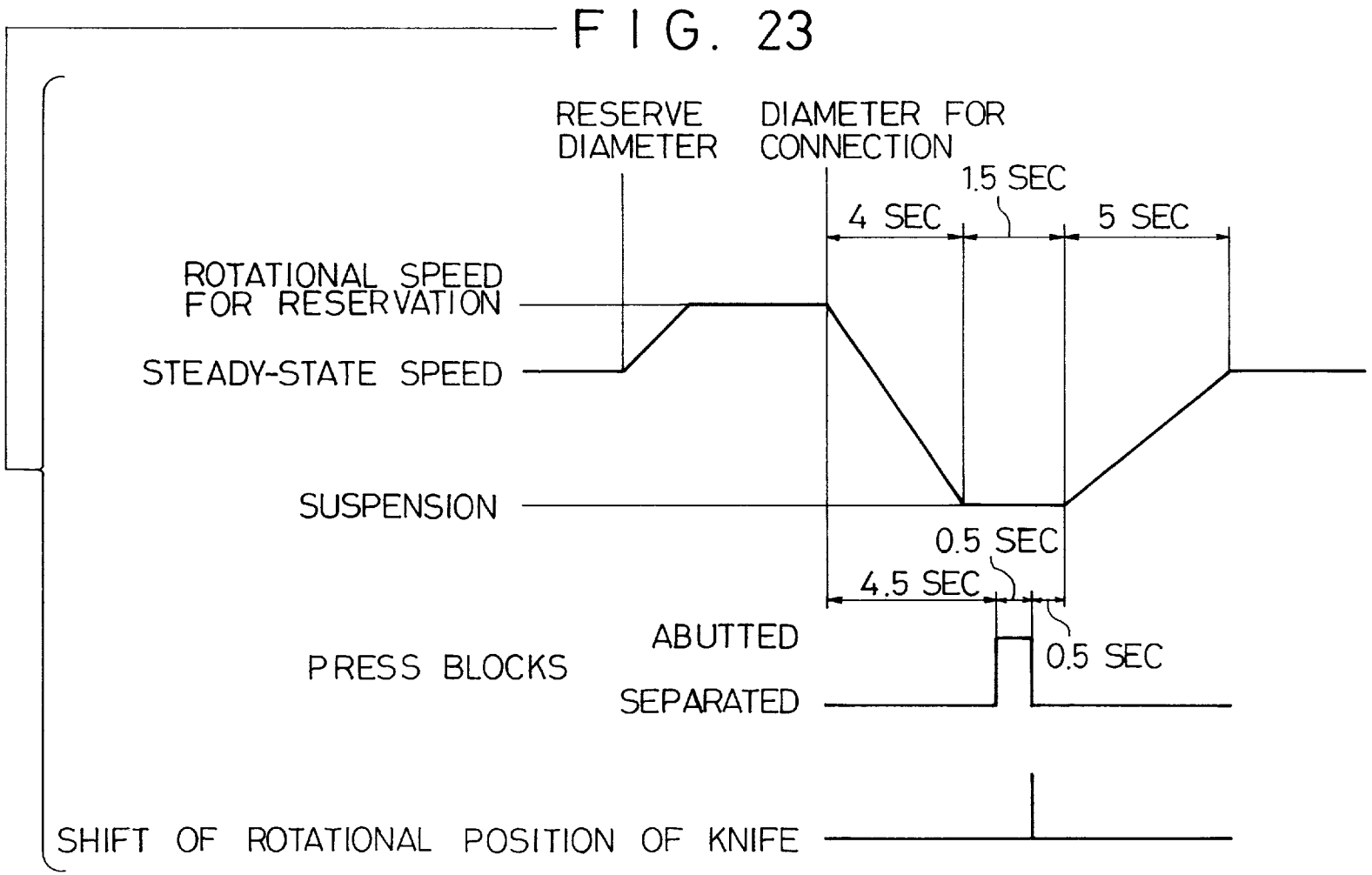
FIG. 23 is a diagram showing the timing for the paper web connection in the paper web feeding apparatus shown in FIG. 2.

Furthermore, when it is detected by a sensor 270 that the press blocks 70, 70' pressed against each other are separated, a corresponding one of valves 82*d*, 82*e* associated with the rotary cylinder 82 of the cutter mechanism 66 (FIG. 9) is operated under the control of the control unit 200 which responds to a detection output of the sensor 270, so that the rotating shaft of the cylinder 82 rotates. As a result, the shaft 80 rotates in the direction of arrow C of FIG. 22, whereby the rotational position of the front knife 81 is shifted so that the knife 81 faces the rear knife 86', which is fixed to the press block 70', to be ready for the paper web connection in the next stage (FIG. 23).

When connecting the paper webs 1 and 1' is finished, the pulling roller 15 is rotated (FIG. 23) to deliver the virgin paper web 1'. The position of the Joint or doubled web portion at which the terminal end 1*a* of the web 1 and the starting end 1'*a* of the web 1' are lapped and connected is detected by means of the paper web Joint sensor (not shown), and a plurality of cigarettes (e.g., five in number) are automatically removed from a double-web inspection/cutting drum section (not shown).

When the remainder of the paper web 1' on the bobbin 12' becomes insufficient, a virgin paper web is set anew on the bobbin 12 in the same manner as aforesaid, the starting end of the new web is connected to the paper web 1' in service, and the web 1' is cut. In this manner, virgin paper webs are set alternately on the bobbins 12 and 12' to ensure continuous paper web supply. Mounting the reels on the bobbins 12 and 12', starting reservation, connecting the paper webs, etc. are controlled by means of the control unit 200 which operates in response to signals from a timing disk on the back of the pulling roller 15 and the rotary encoders (only one of which is designated by numeral 52) attached individually to the bobbins 12 and 12'. Thus, the supply of the paper webs to the bobbins 12 and 12' and the paper web connection can be automatically executed after making only simple arrangements.

It is to be understood that the present invention is not limited to the embodiment described above, and that various changes and modifications may be effected therein by one skilled in the art without departing from the scope or spirit of the invention.

According to the above-described embodiment, for example, the present invention is applied to automatic paper web connecting apparatus used in the paper web feeding apparatus of the cigarette manufacturing machine. The invention may, however, be also applied to any other automatic belt-shaped material connecting apparatuses used in, for example, a packaging material feeding apparatus for the cigarette manufacturing machine.

In the foregoing embodiment, moreover, the compressed air supply to the air cylinder 72 and the negative pressure supply to the press blocks 70 and 70' are controlled by means of the manual valves. Alternatively, however, the compressed air supply and the negative pressure supply may be controlled by using solenoid valves which operate, for example, under the control of the control unit 200.

According to the embodiment described herein, furthermore, the solenoid valve 211 which operates under the control of the control unit 200 is used to supply the compressed air to the air cylinder 51 for driving the variable-diameter holder, and the solenoid valves 82*d* and 82*e* are used to supply compressed air to the rotating cylinder 82. Alternatively, however, manual valves may be used for these purposes.

From the above-described embodiments of the present invention, it is apparent that the present invention may be modified as would occur to one of ordinary skill in the art without departing from the spirit and scope of the present invention which should be defined solely by the appended claims. All such modifications as would be obvious to one of ordinary skill in the art should not be regarded as a departure from the spirit and scope of the invention, and should be included within the scope of the invention as defined solely by the appended claims.

From the above-described embodiment of the present invention, it is apparent that the present invention may be modified as would occur to one of ordinary skill in the art without departing from the spirit and scope of the present invention which should be defined solely by the appended claims. All such modifications as would be obvious to one of ordinary skill in the art should not be regarded as a departure from the spirit and scope of the invention, and should be included within the scope of the invention as defined solely by the appended claims.

What is claimed is:

1. An automatic web material connecting apparatus comprising:

a pair of blocks arranged so as to be able to move relatively and be pressed against each other in a direction to cross a feed path for a first web material and a feed path for a second web material;

retaining means for retaining the first and second web materials on respective opposite faces of said pair of blocks;

cutting means, associated with said pair of blocks, for cutting a desired one of the first and second web materials; and driving means for relatively moving said pair of blocks, whereby the desired web material is cut by said cutting means while said pair of blocks are moving relative to each other;

wherein said cutting means essentially consists of:

a rotating body rockable between the feed paths for the first and second web materials on an upper-course side of said pair of blocks, first and second knives fixed individually to said pair of blocks, a single third knife fixed to said rotating body, and actuator means for rotating said rotating body between a first rotational position in which said third knife faces said first knife and a second rotational position in which said third knife faces said second knife, said third knife having a cutting edge which is directed to different radial directions as said rotating body rotates between the first and second rotational positions, wherein the desired web material is cut by said third knife and one of said first and second knives selected depending on the rotational position of said rotating body.

2. The automatic belt-shaped material connecting apparatus according to claim 1, further including:

first and second guide rollers, spaced at a distance from each other; and a third guide roller for defining the feed path for the first web material in conjunction with said first guide roller and defining the feed path for the second web material in conjunction with said second guide roller.

3. The automatic web material connecting apparatus according to claim 1, wherein each of said pair of blocks is movable.

4. The automatic web material connecting apparatus according to claim 3, wherein said driving means includes a linear rail on which said pair of blocks are slidably placed, a pair of connecting rods, each having one end connected to a corresponding one of said pair of blocks, and a single cylinder actuator having a rod connected with respective other ends of said connecting rods, whereby said pair of blocks are linearly moved along said linear rail as said rod of said cylinder actuator moves.

5. The automatic web material connecting apparatus according to claim 1, wherein said retaining means produces a negative pressure to attract the first and second web materials to the opposite faces of said pair of blocks.

6. The automatic web material connecting apparatus according to claim 1, wherein at least one of the opposite faces of said pair of blocks is formed of an elastic material.

7. An automatic web material connecting apparatus comprising:

a pair of blocks arranged so as to be able to move relatively and be pressed against each other in a direction to cross a feed path for a first web material and a feed path for a second web material;

retaining means for retaining the first and second web materials on respective opposite faces of said pair of blocks;

cutting means, associated with said pair of blocks, for cutting a desired one of the first and second web materials; and driving means for relatively moving said pair of blocks, whereby the desired web material is cut by said cutting means while said pair of blocks are moving relative to each other;

wherein said cutting means includes, a rotating body rockable between the feed paths for the first and second web materials on an upper-course side of said pair of blocks, first and second knives fixed individually to said pair of blocks, a single third knife fixed to said rotating body, and actuator means for rotating said rotating body between a first rotational position in which said third knife faces said first knife and a second rotational position in which said third knife faces said second knife, said third knife having a cutting edge which is directed to different radial directions as said rotating body rotates between the first and second rotational positions, wherein the desired web material is cut by said third knife and one of said first and second knives selected depending on the rotational position of said rotating body.

8. The automatic belt-shaped material connecting apparatus according to claim 7, further including:

first and second guide rollers, spaced at a distance from each other; and a third guide roller for defining the feed path for the first web material in conjunction with said first guide roller and defining the feed path for the second web material in conjunction with said second guide roller.

9. The automatic web material connecting apparatus according to claim 7, wherein each of said pair of blocks is movable.

10. An automatic belt-shaped material connecting apparatus according to claim 9, wherein said driving means includes a linear rail on which said pair of blocks are slidably placed, a pair of connecting rods, each having one end connected to a corresponding one of said pair of blocks, and a single cylinder actuator having a rod connected with respective other ends of said connecting rods, whereby said pair of blocks are linearly moved along said linear rail as said rod of said cylinder actuator moves.

11. The automatic web material connecting apparatus according to claim 7, wherein said retaining means produces a negative pressure to attract the first and second web materials to the opposite faces of said pair of blocks.

12. The automatic web material connecting apparatus according to claim 7, wherein at least one of the opposite faces of said pair of blocks is formed of an elastic material.

* * * * *